US008188186B2

(12) United States Patent
Okabe

(10) Patent No.: US 8,188,186 B2
(45) Date of Patent: May 29, 2012

(54) GOLF BALL

(75) Inventor: Satoko Okabe, Kobe (JP)

(73) Assignee: SRI Sports Limited, Kobe (JP)

( * ) Notice: Subject to any disclaimer, the term of this patent is extended or adjusted under 35 U.S.C. 154(b) by 478 days.

(21) Appl. No.: 12/425,746

(22) Filed: Apr. 17, 2009

(65) Prior Publication Data

US 2009/0270203 A1 Oct. 29, 2009

(30) Foreign Application Priority Data

Apr. 28, 2008 (JP) ..... 2008-117574

(51) Int. Cl.
*A63B 37/00* (2006.01)
*A63B 37/12* (2006.01)
*C08L 33/02* (2006.01)

(52) U.S. Cl. ..... 525/133; 525/132; 525/166; 525/175; 525/176; 525/179; 525/182; 525/183; 473/373; 473/374

(58) Field of Classification Search ..... None
See application file for complete search history.

(56) References Cited

U.S. PATENT DOCUMENTS

| | | | | |
|---|---|---|---|---|
| 5,605,968 | A * | 2/1997 | Egashira et al. | 525/221 |
| 5,656,695 | A * | 8/1997 | Endo et al. | 525/221 |
| 5,713,802 | A * | 2/1998 | Moriyama et al. | 473/374 |
| 5,789,021 | A * | 8/1998 | Dooms et al. | 427/64 |
| 5,820,486 | A | 10/1998 | Tanaka et al. | |
| 5,869,578 | A | 2/1999 | Rajagopalan | |
| 5,976,034 | A * | 11/1999 | Kato et al. | 473/363 |
| 6,012,991 | A | 1/2000 | Kim et al. | |
| 6,966,849 | B2 | 11/2005 | Kato | |
| 7,393,289 | B2 | 7/2008 | Egashira et al. | |
| 2002/0098915 | A1* | 7/2002 | Cavallaro et al. | 473/354 |
| 2002/0147280 | A1* | 10/2002 | Rajagopalan | 525/179 |
| 2004/0029648 | A1 | 2/2004 | Kato | |
| 2004/0121856 | A1 | 6/2004 | Iwami | |
| 2004/0235587 | A1* | 11/2004 | Sullivan et al. | 473/371 |
| 2006/0063893 | A1* | 3/2006 | Rajagopalan | 525/418 |
| 2006/0293121 | A1 | 12/2006 | Egashira et al. | |
| 2007/0049419 | A1 | 3/2007 | Egashira et al. | |
| 2008/0227569 | A1 | 9/2008 | Egashira et al. | |
| 2008/0242447 | A1 | 10/2008 | Egashira et al. | |
| 2010/0093466 | A1* | 4/2010 | Ohama et al. | 473/374 |

FOREIGN PATENT DOCUMENTS

| | | | |
|---|---|---|---|
| JP | 62-22841 | A | 1/1987 |
| JP | 06145486 | * | 5/1994 |
| JP | 9-38238 | A | 2/1997 |
| JP | 10-328326 | A | 12/1998 |
| JP | 2003-504089 | A | 2/2003 |
| JP | 2004-187991 | A | 7/2004 |
| JP | 2004-305754 | A | 11/2004 |
| JP | 2007-622 | A | 1/2007 |
| JP | 2007-61605 | A | 3/2007 |

OTHER PUBLICATIONS

DuPont product literature for Surlyn 8940, no date.*
English translation of Japanese Office Action dated Mar. 22, 2011, for Application No. 2008-264249.
Japanese Office Action with the English translation dated Feb. 21, 2012, for Application No. 2008-117574.

* cited by examiner

*Primary Examiner* — David Buttner
(74) *Attorney, Agent, or Firm* — Birch, Stewart, Kolasch & Birch, LLP

(57) ABSTRACT

An object of the present invention is to provide a golf ball having excellent durability and flight distance. The present invention provides a golf ball comprising: a core consisting of a center and one or more intermediate layers covering the center; and a cover covering the core, wherein, at least one piece or one layer of said intermediate layers is formed from a highly elastic intermediate layer composition that contains a highly elastic resin (A) having a flexural modulus in a range from 700 MPa to 5000 MPa and an ionomer resin (B) having a flexural modulus in a range from 150 MPa to 1000 MPa in an amount ratio ((A)/(B)) of the highly elastic resin (A) to the ionomer resin (B) being (20 mass % to 80 mass %)/(80 mass % to 20 mass %) (the total is 100 mass %).

9 Claims, No Drawings

GOLF BALL

FIELD OF THE INVENTION

The present invention relates to a golf ball having excellent durability and flight distance.

DESCRIPTION OF THE RELATED ART

Conventionally, in three-piece golf balls and multi-piece golf balls, ionomer resins having a high acid content and ionomer resins having a large degree of neutralization are used in the composition for an intermediate layer to enhance the rigidity of the intermediate layer, thereby increasing the launch angle and decreasing the spin rate. By doing so, golf balls having improved flight distance are developed.

However, when ionomer resins having a large acid amount are used in the intermediate layer composition, there is a problem that the durability of the golf ball deteriorates. Further, when ionomer resins having a large degree of neutralization are used in the intermediate layer composition, there is a problem that the formability of the intermediate layer composition deteriorates.

For that reason, there have been proposals of golf balls in which the rigidity of the intermediate layer is enhanced without using such an ionomer resin having a high acid content or a large degree of neutralization. For example, Japanese Patent Publication No. 2004-187991 A (Patent Document 1) discloses a multi-piece solid golf ball which includes a center (1), an intermediate layer (2) formed on the center, and a cover (3) covering the intermediate layer, wherein the intermediate layer (2) is formed from only one type of material having a flexural rigidity in a range from 400 to 5,000 MPa. Further, Japanese Patent Publication No. H9-38238 A (Patent Document 2) discloses a golf ball including a core and a cover consisting of an inner cover and an outer cover. The inner cover is made from a resin composition, which contains, in a weight ratio ranging from 95:5 to 50:50, a polyamide resin having a flexural modulus in a range from 6000 to 30000 kgf/cm$^2$ in equilibrium at a temperature of 23° C. and a relative humidity of 50% and a thermoplastic elastomer having a JIS-A hardness in a range from 30 to 98°, and which has a flexural modulus in a range from 5000 to 12000 kgf/cm$^2$ in equilibrium at a temperature of 23° C. and a relative humidity of 50%.

Further, Japanese Patent Publication No. 2007-61605 A (Patent Document 3) discloses, as a material usable for an intermediate layer, a golf ball material that essentially contains the following components (A) to (C): an olefin-containing thermoplastic polymer (A) having an acid content of 0.5 mass % or more and less than 5.0 mass %; a resin composition (B) including one or more types selected from a group consisting of diene-based polymers, thermoplastic polymers, and thermosetting polymers; and an oxygen-containing organic metallic compound (C).

SUMMARY OF THE INVENTION

In the golf ball disclosed in the Patent Document 1, however, increasing of launch angle and decreasing of spin rate are discussed but the resilience of the golf ball is not discussed. Thus, there is room for improvements regarding increasing of flight distance. In addition, there is room for improvements in light of durability. Further, for the golf ball disclosed in the Patent Document 2, there is room for improvements regarding increasing of flight distance. Further, although the Patent Document 3 describes that the golf ball material according to the invention of the Patent Document 3 is usable for an intermediate layer, the durability and the flight distance when using the golf ball material for the intermediate layer are not considered at all. Further, when the rigidity of the intermediate layer is enhanced as in the golf balls disclosed in the Patent Documents 1 to 3, there is a problem that the durability of the intermediate layer deteriorates.

The present invention has been made in view of the above situation and an objective of the present invention is to provide a golf ball having excellent durability and flight distance.

The present invention that can solve the above problems provides a golf ball comprising:

a core consisting of a center and one or more intermediate layers covering the center; and a cover covering the core, wherein, at least one piece or one layer of said intermediate layers is formed from a highly elastic intermediate layer composition that contains a highly elastic resin (A) having a flexural modulus in a range from 700 MPa to 5000 MPa and an ionomer resin (B) having a flexural modulus in a range from 150 MPa to 1000 MPa in an amount ratio ((A)/(B)) of the highly elastic resin (A) to the ionomer resin (B) being (20 mass % to 80 mass %)/(80 mass % to 20 mass %) (the total is 100 mass %).

In other words, the golf ball of the present invention includes an intermediate layer formed from a highly elastic intermediate layer composition that contains a highly elastic resin (A) and an ionomer resin (B) in a predetermined amount, and hence a hardness distribution of the core becomes outer-hardness and inner softness. Thus, the launch angle can be increased and the spin rate can be decreased upon a shot with a driver and the like, and the resilience of the golf ball can be improved, thereby obtaining a large flight distance. Further, by the highly elastic intermediate layer composition containing the highly elastic resin (A) and the ionomer resin (B), the durability can be improved.

Preferably, the highly elastic intermediate layer composition contains a resin (C) having a polar functional group in an amount of 0.1 parts by mass to 30 parts by mass with respect to 100 parts by mass of the sum of the highly elastic resin (A) and the ionomer resin (B). By the highly elastic intermediate layer composition containing the resin (C) having a polar functional group in a predetermined amount, the compatibility and the interface strength between the highly elastic resin (A) and the ionomer resin (B) are improved, thereby further improving the durability of the golf ball.

Preferably, regarding slab properties, the highly elastic intermediate layer composition has a hardness in a range from 65 to 75 in Shore D hardness, a flexural modulus in a range from 300 MPa to 1000 MPa, and a tensile modulus in a range from 400 MPa to 1500 MPa.

Preferably, the highly elastic resin is at least one selected from a group consisting of polybutylene terephthalate, a polymer alloy of polyphenylene ether and polyamide 6, and a polymer alloy of polyphenylene ether and polyamide 66. Further, preferably, the resin (C) having a polar functional group is at least one selected from a group consisting of an ethylene-glycidyl methacrylate copolymer, an ethylene-acrylic acid-glycidyl methacrylate copolymer, and a methyl methacrylate-glycidyl methacrylate copolymer.

Preferably, the cover is formed from a cover composition that contains a polyurethane resin as the principal component of a resin component. By using a thermoplastic or thermosetting polyurethane as the main component of the cover, the spin rate upon a shot with a short iron and the like is stabilized, thereby improving the controllability of the golf ball.

According to the present invention, a golf ball having excellent durability and flight distance is obtained.

DESCRIPTION OF THE PREFERRED EMBODIMENT

A golf ball of the present invention comprises: a core consisting of a center and one or more intermediate layers covering the center; and a cover covering the core, wherein, at least one piece or one layer of said intermediate layers is formed from a highly elastic intermediate layer composition that contains a highly elastic resin (A) having a flexural modulus in a range from 700 MPa to 5000 MPa and an ionomer resin (B) having a flexural modulus in a range from 150 MPa to 1000 MPa in an amount ratio ((A)/(B)) of the highly elastic resin (A) to the ionomer resin (B) being (20 mass % to 80 mass %)/(80 mass % to 20 mass %) (the total is 100 mass %).

First, the highly elastic resin (A) having a flexural modulus in a range from 700 MPa to 5000 MPa used in the highly elastic intermediate layer composition (hereinafter, may be referred to merely as "highly elastic resin (A)") will be described.

The highly elastic resin (A) is not particularly limited, as long as it is a resin having a flexural modulus in a range from 700 MPa to 5000 MPa, and any of thermoplastic resins and thermosetting resins can be used.

As the highly elastic resin (A), so-called engineering plastics can be used, and examples include polybutylene terephthalate (PBT), polyphenylene ether (PPE), polyethylene terephthalate (PET), polyethylene (PE), polypropylene (PP), polysulfone (PSF), polyether sulphone (PES), polyphenylene sulfide (PPS), polyallylate (PAR), polyamide-imide (PAI), polyether-imide (PEI), polyether ether ketone (PEEK), polyimide (PI), polytetrafluoroethylene (PTFE), polyamino bismaleimide (PABM), polybisamide triazole, polyphenylene oxide (PPO), polyacetal, polycarbonate, acrylonitrile-butadiene-styrene copolymer (ABS), acrylonitrile-styrene copolymer (AS), and the like. They may be used solely or in combination of two or more types thereof.

Among them, polybutylene terephthalate (PBT), a polymer alloy of polyphenylene ether (PPE) and polyamide (PA) are preferable, and a polymer alloy of polyphenylene ether (PPE) and polyamide 6 or a polymer alloy of polyphenylene ether (PPE) and polyamide 66 is particularly preferable. By using such a polymer alloy, the impact resistance of the intermediate layer and the formability of the highly elastic intermediate layer composition can be improved more than when an engineering plastic is used solely.

The flexural modulus of the highly elastic resin (A) is 700 MPa or more, preferably 750 MPa or more, and more preferably 800 MPa or more. If the flexural modulus of the highly elastic resin (A) is less than 700 MPa, the rigidity of the intermediate layer is insufficient, and hence the effect of decreasing the spin rate is not obtained. Further, the flexural modulus of the highly elastic resin (A) is 5000 MPa or less, preferably 4500 MPa or less, and more preferably 4000 MPa or less. If the flexural modulus of the highly elastic resin (A) exceeds 5000 MPa, the rigidity of the intermediate layer is excessively enhanced, and hence the shot feeling and the durability deteriorate. In the present invention, the flexural modulus is a value measured according to ISO 178.

Specific examples of the highly elastic resin (A) include polycarbonates such as "lupilon (registered trademark) S3000, lupilon PM1220", "NOVAREX (registered trademark) 7072A, and NOVAREX 7027A" manufactured by Mitsubishi Engineering-Plastics Company, "Caliver (registered trademark) 301-4" manufactured by Sumitomo Dow Limited, "TAFLON (registered trademark) IR190DH and TAFLON RE2200" manufactured by Idemitsu Kosan Co., Ltd., and the like; modified polyphenylene ethers (PPE) such as "lupiace (registered trademark) AN20", "LEMMALOY (registered trademark) C61 HL, LEMMALOY C82HL, LEMMALOY BX505, LEMMALOY BX528A-3, LEMMALOY PX600, LEMMALOY EX700A, and LEMMALOY CX555A" manufactured by Mitsubishi Engineering-Plastics Company, "ZAIRON (registered trademark) 100VV1" manufactured by Asahi Kasei Corporation, "ARTLEX (registered trademark) HT4400 and ARTLEX HT4500" manufactured by Sumitomo Chemical Co., Ltd., and the like; modified polyphenylene oxides (modified PPOs) such as "Noryl (registered trademark) STN15" manufactured by Japan General Electric Company and the like; polyacetals such as "lupital (registered trademark) F10, lupital FU2025, and lupital FU2050" manufactured by Mitsubishi Engineering-Plastics Company, "DURACON (registered trademark) M90-44 and DURACON NT-35" manufactured by Polyplastics Co., Ltd., "Tenac (registered trademark) 4010" manufactured by Asahi Kasei Corporation, and the like; polybutylene terephthalates (PBTs) such as "NOVADURAN (registered trademark) 5505S, NOVADURAN 5503R1, NOVADURAN 5505R1, NOVADURAN 5510R1, and NOVADURAN 5010R8M" manufactured by Mitsubishi Engineering-Plastics Company, "DURANEX (registered trademark) 2002" manufactured by Polyplastics Co., Ltd., "TUFPET (registered trademark) N1003" manufactured by Mitsubishi Rayon Co., Ltd., "Traycon (registered trademark) 5201X10 and Traycon 5201 X11" manufactured by Toray Industries Inc., "Crastin (registered trademark) ST820 and Crastin ST830FR" manufactured by E.I. du Pont de Nemours and Company, "Ultradur (registered trademark) KR4071" manufactured by BASF Japan Ltd., "PLANAC (registered trademark) BT-1500" manufactured by DIC Corporation, and the like; and polyolefins such as "NOVATEC XK1159 and NOVATEC XKK1181" manufactured by Japan Polychem Corporation, and the like.

The content of the highly elastic resin (A) in the resin component contained in the highly elastic intermediate layer composition is preferably 20 mass % or more, more preferably 25 mass % or more, and even more preferably 30 mass % or more, and is preferably 80 mass % or less, more preferably 75 mass % or less, and even more preferably 70 mass % or less. If the content of the highly elastic resin (A) in the resin component contained in the highly elastic intermediate layer composition is 20 mass % or more, the flexural modulus of the highly elastic intermediate layer composition can be increased to a desired value. Thus, the effect of decreasing the spin rate is obtained, and the flight distance can be improved. On the other hand, if the amount of the highly elastic resin (A) in the resin component contained in the highly elastic intermediate layer composition is 80 mass % or less, the flexural modulus of the highly elastic intermediate layer composition is not excessively increased. Thus, desirable durability and shot feeling of the resultant golf ball are obtained.

Next, the ionomer resin (B) having a flexural modulus in a range from 150 MPa to 1000 MPa and used for the highly elastic intermediate layer composition will be described.

The ionomer resin (B) having a flexural modulus in a range from 150 MPa to 1000 MPa and contained in the highly elastic intermediate layer composition (hereinafter, may be referred to merely as ionomer resin (B)) is a resin in which at least a part of acidic groups contained in the polymer is neutralized with a metal ion and which has a flexural modulus in a range from 150 MPa to 1000 MPa.

The ionomer resin (B) is not particularly limited, as long as it has a flexural modulus in a range from 150 MPa to 1000 MPa, and examples include an ionomer resin obtained by neutralizing at least a part of carboxyl groups in a binary copolymer of ethylene and an α,β-unsaturated carboxylic acid having 3 to 8 carbon atoms with a metal ion; an ionomer resin obtained by neutralizing at least a part of carboxyl groups in a ternary copolymer of ethylene, an α,β-unsaturated carboxylic acid having 3 to 8 carbon atoms, and an α,β-unsaturated carboxylic acid ester with a metal ion; and a mixture thereof. As the ionomer resin (B), one prepared by neutralizing an ethylene-(meth)acrylic acid binary copolymer with a metal ion, one prepared by neutralizing an ethylene-(meth)acrylic acid-(meth)acrylic acid ester ternary copolymer with a metal ion, and a mixture thereof are particularly preferable. In the present application, a (meth) acrylic acid means acrylic acid, methacrylic acid, or a mixture thereof.

The flexural modulus of the ionomer resin (B) is 150 MPa or more, preferably 180 MPa or more, and more preferably 200 MPa or more, and is 1000 MPa or less, preferably 800 MPa or less, and more preferably 600 MPa or less. If the flexural modulus of the ionomer resin (B) is less than 150 MPa, the elastic modulus of the intermediate layer becomes low, and the effects of increasing the launch angle and of decreasing the spin rate are decreased. On the other hand, if the flexural modulus of the ionomer resin (B) exceeds 1000 MPa, the elastic modulus of the intermediate layer becomes excessively high, and the durability and the shot feeling of the golf ball deteriorate.

The acid content of the ionomer resin (B) is preferably 5 mass % or more, more preferably 9 mass % or more, and even more preferably 11 mass % or more, and is preferably 30 mass % or less, more preferably 25 mass % or less, and even more preferably 20 mass % or less. By causing the acid content to be 5 mass % or more and 30 mass % or less, desired hardness and rigidity are obtained while the fluidity of the highly elastic intermediate layer composition is maintained. The term "acid content" as used herein refers to as the content of an acidic group-containing component(s) in a resin. The term "acidic group-containing component" as used herein refers to as a monomer component containing an acidic group such as a carboxyl group and the like, for example, a carboxyl group-containing monomer component such as an α,β-unsaturated carboxylic acid and the like.

Examples of a metal (ion) used for neutralization for the ionomer resin (B) include: monovalent metals (ions), such as sodium, potassium, lithium, and the like; divalent metals (ions), such as magnesium, calcium, zinc, barium, cadmium, and the like; trivalent metals (ions), such as aluminum and the like; and other metals (ions), such as tin, zirconium, and the like. Among these metals (ions), sodium, zinc and magnesium (ions) are particularly preferably used because they provide excellent resilience, durability, or the like.

The degree of neutralization of the acidic groups contained in the ionomer resin (B) is preferably 10 mol % or more, more preferably 15 mol % or more, and even more preferably 20 mol % or more, and is preferably 90 mol % or less, more preferably 80 mol % or less, and even more preferably 70 mol % or less. The degree of neutralization of the acidic groups in the ionomer resin (B) can be calculated by using the following mathematical expression 1.

Degree of neutralization (mol %)=
(the number of moles of acidic groups neutralized in an ionomer resin/the number of moles of all acidic groups contained in the ionomer resin)×100 [Mathematical Expression 1]

Specific examples of the ionomer resin (B) include trade name "Himilan (registered trademark) (e.g. Himilan 1555 (Na), Himilan 1557 (Zn), Himilan 1605 (Na), Himilan 1706 (Zn), Himilan 1707 (Na), Himilan AM7311 (Mg), Himilan AM7329 (Zn), and the like)" commercially available from Du Pont-Mitsui Polychemicals Co., Ltd.

Further, ionomer resins commercially available from E.I. du Pont de Nemours and Company include trade name "Surlyn (registered trademark) (e.g. Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li), and the like)", "HPF 1000 (Mg)", and the like.

Further, ionomer resins commercially available from ExxonMobil Chemical Corporation include trade name "Iotek (registered trademark) (e.g. Iotek 8000 (Na), Iotek 8030 (Na), Iotek 7010 (Zn), Iotek 7030 (Zn), and the like)".

It is noted that Na, Zn, Li, and Mg described in the parentheses after the trade names of the ionomer resins indicate metal types of neutralizing metal ions for these ionomer resins.

The content of the ionomer resin (B) in the resin component contained in the highly elastic intermediate layer composition is preferably 20 mass % or more, more preferably 25 mass % or more, even more preferably 30 mass % or more, and is preferably 80 mass % or less, more preferably 75 mass % or less, and even more preferably 70 mass % or less. By causing the content of the ionomer resin (B) in the resin component contained in the highly elastic intermediate layer composition to be 20 mass % or more, the resilience of the golf ball can be improved. On the other hand, by causing the content of the ionomer resin (B) in the resin component contained in the highly elastic intermediate layer composition to be 80 mass % or less, the elastic modulus of the intermediate layer can be in an appropriate range, and hence the effects of increasing the launch angle and of decreasing the spin rate can be enhanced.

The content ratio (highly elastic resin (A)/ionomer resin (B)) of the highly elastic resin (A) to the ionomer resin (B) (the total is 100 mass %) in the highly elastic intermediate layer composition is preferably (20 mass % to 80 mass %)/(80 mass % to 20 mass %). By causing the content ratio of the highly elastic resin (A) to the ionomer resin (B) to be in the above range, the intermediate layer has a desired elastic modulus, and the launch angle is increased and the spin rate is decreased, thereby improving the flight distance of the golf ball. The content ratio ((A)/(B)) of the highly elastic resin (A) to the ionomer resin (B) (the total is 100 mass %) in the highly elastic intermediate layer composition is more preferably (25 mass % to 75 mass %)/(75 mass % to 25 mass %) and more preferably (30 mass % to 70 mass %)/(70 mass % to 30 mass %).

Further, in addition to the highly elastic resin (A) and the ionomer resin (B), a resin (C) having a polar functional group may be also contained in the highly elastic intermediate layer composition.

The resin (C) having a polar functional group is a resin obtained by copolymerizing a monomer having a polar functional group and a monomer not having a polar functional group. Herein, the polar functional group is a functional group having a polarity and becomes a factor that allows a resin to possess polarity, and examples include an epoxy group, a hydroxyl group, an amino group, a nitro group, a carboxyl group, a formyl group, a nitrile group, a sulfonic group, and the like.

Because the main backbone of the resin (C) having a functional group has a low polarity, the main backbone is highly compatible with the highly elastic resin (A). Because the functional group introduced in the resin (C) has a high polarity, the functional group (side chain portion) is highly compatible with the ionomer resin (B). Thus, by causing the highly elastic intermediate layer composition to contain the resin (C) having a polar functional group, the dispersibility of the highly elastic resin (A) and the ionomer resin (B) can be improved, and hence the durability of the golf ball can be further improved.

Examples of the monomer having a polar functional group include, but are not limited to, epoxy group-containing monomers such as glycidyl (meth)acrylate, 2-vinyloxirane, (allyloxy)oxirane, and the like; hydroxyl group-containing monomers such as 2-hydroxyethyl (meth)acrylate, 2-hydroxypropyl (meth)acrylate, vinyl alcohol, allyl alcohol, 2-hydroxyethyl vinyl ether, and the like; sulfonic group-containing monomers such as vinyl sulfonic acid and the like; and carboxyl group-containing monomers such as (meth)acrylic acid, itaconic acid, maleic anhydride, and the like. These monomers having polar functional groups may be used solely or in combination of two or more thereof. Among them, as the monomer having a polar functional group, epoxy group-containing monomers are preferable, and in particular, glycidyl (meth)acrylate is more preferable. An epoxy group can further improve the interface strength between the highly elastic resin (A) and the ionomer resin (B) because it has reactivity with the carboxyl group contained in the ionomer resin (B).

Examples of the monomer not having a polar functional group include, but are not limited to, olefins such as ethylene, propylene, 1-buten, isobutene, 1-penten, and the like; and alkyl (meth)acrylates such as methyl (meth)acrylate, ethyl (meth)acrylate, propyl (meth)acrylate, n-butyl (meth)acrylate, isobutyl (meth)acrylate, and the like. These monomers not having polar functional groups may be used solely or in combination of two or more types thereof. Among them, as the monomer not having a polar functional group, ethylene and methyl (meth) acrylate are preferable.

The content of the monomer component having a polar functional group in the resin (C) having a polar functional group is preferably 0.1 mass % or more, more preferably 0.5 mass % or more, and even more preferably 1 mass % or more, and is preferably 30 mass % or less, more preferably 25 mass % or less, even more preferably 20 mass % or less. By causing the content of the monomer component having a polar functional group in the resin (C) having a polar functional group to be in the above range, the dispersibility of the highly elastic resin (A) and the ionomer resin (B) can be sufficiently enhanced.

Examples of the resin (C) having a polar functional group include a (meth)acrylic acid ester-glycidyl (meth)acrylate copolymer, an epoxy group-containing (meth)acrylic-based polymer, an ethylene-glycidyl (meth)acrylate copolymer, an ethylene-(meth)acrylic acid copolymer, an ethylene-(meth) acrylic acid-(meth)acrylic acid ester copolymer, an ethylene-(meth)acrylic acid ester-glycidyl (meth)acrylate copolymer, a maleic acid modified styrene-ethylene-butylene-styrene block polymer (SEBS), a maleic acid modified styrene-ethylene-butylene-olefin crystalline block polymer (SEBC), maleic acid modified polyethylene (PE), maleic acid modified polypropylene (PP), maleic acid modified ethylene-vinyl acetate copolymer (EVA), a maleic acid modified ethylene-propylene-diene rubber (EPDM), an epoxy group-containing styrene-based polymer, and the like. These resins (C) having polar functional groups may be used solely or in combination of two or more types thereof. Among them, an ethylene-glycidyl (meth)acrylate copolymer, an ethylene-(meth) acrylic acid ester-glycidyl (meth)acrylate copolymer, and a methyl methacrylate-glycidyl methacrylate copolymer are preferable, and in particular, an ethylene-glycidyl methacrylate copolymer and the mixture of an ethylene-glycidyl methacrylate copolymer and another resin (C) having a polar functional group are preferable.

It is noted that as the resin (C) having a polar functional group, a so-called ionomer resin obtained by neutralizing a part of polar functional groups in a resin with a metal ion can be used. In this case, an ionomer resin having a flexural modulus of 150 MPa or more is used as the ionomer resin (B), and an ionomer resin having a flexural modulus less than 150 MPa is used as the resin (C) having a polar functional group.

Specific examples of the resin (C) having a polar functional group include "LOTARDER AX8840" manufactured by Arkema Inc., "ARUFON (registered trademark) UG-4030" manufactured by Toagosei Co., Ltd., "Bond Fast (registered trademark) E" manufactured by Sumitomo Chemical Co., Ltd., "Tuftec (registered trademark) M1913 and Tuftec M1943" manufactured by Asahi Kasei Corporation, "FUSABOND (registered trademark) NM052D" manufactured by E.I. du Pont de Nemours and Company, "Dynaron (registered trademark) 4630P" manufactured by JSR Corporation, "NUCREL (registered trademark) (e.g. NUCREL AN4214C, NUCREL AN4225C, NUCREL AN42115C, NUCREL N0903HC, NUCREL N0908C, NUCREL AN42012C, NUCREL N410, NUCREL N1035, NUCREL N1050H, NUCREL N1108C, NUCREL N1110H, NUCREL N1207C, NUCREL N1214, NUCREL AN4221C, NUCREL N1525, NUCREL N1560, NUCREL N0200H, NUCREL AN4228C, NUCREL N4213C, NUCREL N035C, and the like) manufactured by Du Pont-Mitsui Polychemicals Co., Ltd., and the like.

Further, specific examples of the ionomer resin having a flexural modulus less than 150 MPa and usable as the resin (C) having a polar functional group include "Himilan (registered trademark) 1856 (Na) and Himilan 1855 (Zn)" manufactured by Du Pont-Mitsui Polychemicals Co., Ltd., "Surlyn (registered trademark) 6320 (Mg), Surlyn 8120 (Na), Surlyn 8320 (Na), Surlyn 9320 (Zn), Surlyn 9320W (Zn)" and "HPF 2000 (Mg)" manufactured by E.I. du Pont de Nemours and Company, "Iotek (registered trademark) 7510 (Zn) and Iotek 7520 (Zn)" manufactured by ExxonMobil Chemical Corporation, and the like. It is noted that Na, Zn, and Mg described in the parentheses after the trade names of the ionomer resins indicate metal types of neutralizing metal ions for these ionomer resins.

The highly elastic intermediate layer composition preferably contains the resin (C) having a polar functional group in an amount of 0.1 parts by mass to 30 parts by mass with respect to 100 parts by mass of the sum of the highly elastic resin (A) and the ionomer resin (B). By the highly elastic intermediate layer composition containing a predetermined amount of the resin (C) having a polar functional group, the compatibility and the interface strength between the highly elastic resin (A) and the ionomer resin (B) are improved, thereby further improving the durability of the golf ball. The amount of the resin (C) having a polar functional group in the highly elastic intermediate layer composition, with respect to 100 parts by mass of the sum of the highly elastic resin (A) and the ionomer resin (B), is preferably 20 parts by mass or less, more preferably 15 parts by mass or less, and even more preferably 10 parts by mass or less. By causing the content of the resin (C) having a polar functional group to be 20 parts by mass or less, the formability is maintained without excessively lowering the fluidity of the highly elastic intermediate layer composition. Further, in order to obtain an effect of improving the dispersibility of the highly elastic resin (A) and the ionomer resin (B), the amount of the resin (C) is preferably 2 parts by mass or more with respect to 100 parts by mass of the sum of the highly elastic resin (A) and the ionomer resin (B).

The highly elastic intermediate layer composition may contain another resin component in addition to the highly elastic resin (A), the ionomer resin (B), and the resin (C) having a polar functional group as long as the resin component does not impair the effects of the present invention. However, it is preferred that the resin component in the highly elastic intermediate layer composition consists of the highly elastic resin (A), the ionomer resin (B), and the resin (C) having a polar functional group. Further, a specific gravity adjusting agent such as barium sulfate and the like, an antioxidant a pigment, and the like may be blended with the highly elastic intermediate layer composition, as long as they do not impair the effects of the present invention.

In a process for producing the golf ball of the present invention, the highly elastic resin (A), the ionomer resin (B), and the resin (C) having a polar functional group are blended, and an additive is blended therewith according to need, to obtain a highly elastic intermediate layer composition. For this blending of the highly elastic intermediate layer composition, for example, it is preferable to use a mixer capable of blending pellet materials, and it is more preferable to use a tumble mixer. Embodiments for blending the highly elastic intermediate layer composition include an embodiment in which the highly elastic resin (A), the ionomer resin (B), the resin (C) having a polar functional group, and an additive such as titanium oxide and the like are blended and extruded to prepare a pellet; and an embodiment in which an additive such as titanium oxide and the like is blended with the ionomer resin (B) and extruded to prepare a white pellet in advance, and the white pellet, the highly elastic resin (A), and the pellet of the resin (C) having a polar functional group are dry-blended.

The slab hardness in Shore D hardness of the highly elastic intermediate layer composition is preferably 65 or more, more preferably 66 or more, and even more preferably 67 or more, and is preferably 75 or less, more preferably 73 or less, and even more preferably 71 or less. By causing the slab hardness in Shore D hardness of the highly elastic intermediate layer composition to be 65 or more, the hardness of the resultant intermediate layer increases, and hence the effects of increasing the launch angle and of decreasing the spin rate are obtained. Further, by causing the slab hardness in Shore D hardness of the highly elastic intermediate layer composition to be 75 or less, the intermediate layer does not become excessively hard, and hence desirable durability of the golf ball is obtained.

The flexural modulus of the highly elastic intermediate layer composition is preferably 300 MPa or more, more preferably 320 MPa or more, and even more preferably 350 MPa or more, and is preferably 1000 MPa or less, more preferably 900 MPa or less, and even more preferably 800 MPa or less. By causing the flexural modulus of the highly elastic intermediate layer composition to be 300 MPa or more, the hardness of the resultant intermediate layer increases, and hence the effects of increasing the launch angle and of decreasing the spin rate are obtained. Further, by causing the flexural modulus of the highly elastic intermediate layer composition to be 1000 MPa or less, the formability of the highly elastic intermediate layer composition does not deteriorate, the intermediate layer does not become excessively hard, and hence desirable durability of the golf ball is obtained.

The tensile modulus of the highly elastic intermediate layer composition is preferably 400 MPa or more, more preferably 410 MPa or more, and even more preferably 420 MPa or more, and is preferably 1500 MPa or less, more preferably 1400 MPa or less, and even more preferably 1300 MPa or less. By causing the tensile modulus of the highly elastic intermediate layer composition to be 400 MPa or more, the hardness of the resultant intermediate layer increases, and hence the effects of increasing the launch angle and of decreasing the spin rate are obtained. Further, by causing the tensile modulus of the highly elastic intermediate layer composition to be 1500 MPa or less, the intermediate layer does not become excessively hard, and hence desirable durability of the golf ball is obtained.

Here, the slab hardness, the flexural modulus, and the tensile modulus of the highly elastic intermediate layer composition are measured by later-described measuring methods. It is noted that the slab hardness, the flexural modulus, and the tensile modulus of the highly elastic intermediate layer composition can be adjusted by appropriately deciding the combination of the highly elastic resin (A), the ionomer resin (B), and the resin (C) having a polar functional group, and appropriately deciding the amount of an additive.

The core used in the golf ball of the present invention will be described. The core used in the present invention consists of a center and one or more intermediate layers covering the center, and at least one piece or at least one layer of the one or more intermediate layers is formed from the aforementioned highly elastic intermediate layer composition.

The core of the golf ball of the present invention includes, for example, a core consisting of a center and a single-layered intermediate layer covering the center, a core consisting of a center and multi-piece or multi-layer of intermediate layers covering the center. The core preferably has a spherical shape. If the core does not have a spherical shape, the cover does not have a uniform thickness. As a result, there exist some portions where the performance of the cover is lowered. On the other hand, the center generally has the spherical shape, but the center may be provided with a rib on the surface thereof so that the surface of the spherical center is divided by the ribs. For example, the surface of the spherical center is evenly divided by the ribs. In one embodiment, the ribs are preferably formed on the surface of the spherical center in an integrated manner, and in another embodiment, the ribs are formed as an intermediate layer on the surface of the spherical center.

The ribs are preferably formed along an equatorial line and meridians that evenly divide the surface of the spherical center, if the spherical center is assumed as the earth. For example, if the surface of the spherical center is evenly divided into 8, the ribs are formed along the equatorial line, any meridian as a standard, and meridians at the longitude 90 degrees east, longitude 90 degrees west, and the longitude 180 degrees east (west), assuming that the meridian as the standard is at longitude 0 degree. If the ribs are formed, the depressed portion divided by the ribs are preferably filled with a plurality of intermediate layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

When the center is covered with a single-layer intermediate layer or multi-layer of intermediate layers as the intermediate layer, at least one layer of the intermediate layer is formed from the highly elastic intermediate layer composition. When the depressed portion divided by the ribs provided on the surface of the center are preferably filled with a plurality of intermediate layers, at least one of the plurality of intermediate layers is formed from the highly elastic intermediate layer composition. It is noted that when the core includes a center and multi-piece of intermediate layers or multi-layer of intermediate layers covering the center, the core may include an intermediate layer which is formed from an intermediate layer composition different from the highly elastic intermediate layer composition, as long as it does not impair the effects of the present invention. In this case, it is preferred that the outermost layer of the core is an intermediate layer formed from the highly elastic intermediate layer composition, and it is preferred that all the multi-piece of intermediate layers or multi-layer of intermediate layers are formed from the highly elastic intermediate layer composition.

Examples of the intermediate layer composition which is different from the highly elastic intermediate layer composition includes, in addition to a later-described rubber composition for the center and the ionomer resin, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polyurethane elastomer having a trade name "Elastollan (registered trademark) (e.g. "Elastollan XNY97A")" commercially available from BASF Japan Ltd., a thermoplastic polystyrene elastomer having a trade name "Rabalon (registered trademark)" commercially available from Mitsubishi Chemical Corporation, and the like. In addition, the intermediate layer composition may contain a specific gravity adjusting agent such as barium sulfate, tungsten, and the like, an antioxidant, a pigment, and the like.

One example of the process for forming the intermediate layer is to cover the center with the highly elastic intermediate layer composition or another intermediate layer composition to form an intermediate layer. The process for forming the intermediate layer is not particularly limited. In one example, the highly elastic intermediate layer composition is molded into hemispherical half shells in advance, and then the center is covered with two half shells and press-molded at the temperature of 130° C. to 170° C. for 1 to 5 minutes. In another example, the highly elastic intermediate layer composition is injection-molded directly onto the center so as to cover the center.

The thickness of the intermediate layer formed from the highly elastic intermediate layer composition is preferably 3.0 mm or less, more preferably 2.5 mm or less, and even more preferably 2.0 mm or less, and is preferably 0.1 mm or more, more preferably 0.5 mm or more, and even more preferably 0.8 mm or less. By causing the thickness of the intermediate layer formed from the highly elastic intermediate layer composition to be 3.0 mm or less, the deterioration of the resilience and the shot feeling of the golf ball are prevented. Further, by causing the thickness of the intermediate layer to be 0.1 mm or more, desirable durability of the golf ball is obtained.

As the center of the golf ball of the present invention, a conventionally known rubber composition (hereinafter simply referred to as "center rubber composition" occasionally) may be employed, and it can be molded by, for example, heat-pressing a rubber composition containing a base rubber, a crosslinking initiator, a co-crosslinking agent, and a filler.

As the base rubber, a natural rubber and/or a synthetic rubber such as a polybutadiene rubber, a natural rubber, a polyisoprene rubber, a styrene polybutadiene rubber, and ethylene-propylene-diene terpolymer (EPDM) may be used. Among them, typically preferred is the high cis-polybutadiene having cis-1,4-bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.3 part by mass or more, more preferably 0.4 part by mass or more, and is preferably 5 parts by mass or less, more preferably 3 parts by mass or less based on 100 parts by mass of the base rubber. If the amount is less than 0.3 part by mass, the core becomes too soft, and the resilience tends to be lowered, and if the amount is more than 5 parts by mass, the core becomes too hard, and the shot feeling may be lowered.

The co-crosslinking agent is not particularly limited as long as it has the effect of crosslinking a rubber molecule by graft polymerization with a base rubber molecular chain; for example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high resilience.

The amount of the co-crosslinking agent to be used is preferably 10 parts or more, more preferably 15 parts or more, even more preferably 20 parts or more, and is preferably 55 parts or less, more preferably 50 parts or less, even more preferably 48 parts or less based on 100 parts of the base rubber by mass. If the amount of the co-crosslinking agent to be used is less than 10 parts by mass, the amount of the crosslinking initiator must be increased to obtain an appropriate hardness, which tends to lower the resilience. On the other hand, if the amount of the co-crosslinking agent to be used is more than 55 parts by mass, the core becomes too hard, so that the shot feeling may be lowered.

The filler contained in the center rubber composition is mainly blended as a specific gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 0.5 parts or more, more preferably 1 part or more, and preferably 30 parts or less, more preferably 20 parts or less based on 100 parts of the base rubber by mass. If the amount of the filler to be blended is less than 0.5 parts by mass, it becomes difficult to adjust the weight, while if it is more than 30 parts by mass, the weight ratio of the rubber component becomes small and the resilience tends to be lowered.

As the center rubber composition, an organic sulfur compound, an antioxidant or a peptizing agent may be blended appropriately in addition to the base rubber, the crosslinking initiator, the co-crosslinking agent and the filler.

As the organic sulfur compound, a diphenyl disulfide or a derivative thereof may be preferably used. Examples of the diphenyl disulfide or the derivative thereof include diphenyl disulfide, a mono-substituted diphenyl disulfide such as bis(4-chlorophenyl) disulfide, bis(3-chlorophenyl) disulfide, bis(4-bromophenyl) disulfide, bis(3-bromophenyl) disulfide, bis (4-fluorophenyl) disulfide, bis(4-iodophenyl) disulfide and bis(4-cyanophenyl) disulfide; a di-substituted diphenyl disulfide such as bis(2,5-dichlorophenyl) disulfide, bis(3,5-dichlorophenyl) disulfide, bis(2,6-dichlorophenyl) disulfide, bis(2,5-dibromophenyl) disulfide, bis (3,5-dibromophenyl) disulfide, bis(2-chloro-5-bromophenyl) disulfide, and bis(2-cyano-5-bromophenyl) disulfide; a tri-substituted diphenyl disulfide such as bis (2,4,6-trichlorophenyl) disulfide, and bis(2-cyano-4-chloro-6-bromophenyl) disulfide; a tetra-substituted diphenyl disulfide such as bis(2,3,5,6-tetra chlorophenyl) disulfide; a penta-substituted diphenyl disulfide such as bis (2,3,4,5,6-pentachlorophenyl) disulfide and bis(2,3,4,5,6-pentabromophenyl) disulfide. These diphenyl disulfides or the derivative thereof can enhance resilience by having some influence on the state of vulcanization of vulcanized rubber. Among them, diphenyl disulfide and bis(pentabromophenyl) disulfide are preferably used since a golf ball having particularly high resilience can be obtained. The amount of the diphenyl disulfide or the derivative thereof to be blended is preferably 0.1 part by mass or more, more preferably 0.3 part by mass or more, and preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the amount of the peptizing agent is preferably 0.1 part or more and is preferably 5 parts or less based on 100 parts of the base rubber by mass.

The center can be obtained by mixing, kneading the above mentioned rubber composition and molding the rubber composition in the mold. The conditions for press-molding the core rubber composition should be determined depending on the rubber composition. The press-molding is preferably carried out for 10 to 60 minutes at the temperature of 130° C. to 200° C. under the pressure of 2.9 MPa to 11.8 MPa. Specifically, the press-molding is preferably carried out for 10 to 60 minutes at the temperature of 130° C. to 200° C. Alternatively, the press-molding is preferably carried out in a two-step heating, for example, for 20 to 40 minutes at the temperature of 130° C. to 150° C., and continuously for 5 to 15 minutes at the temperature of 160° C. to 180° C.

The diameter of the center is preferably 25 mm or more and more preferably 30 mm or more, and is preferably 41 mm or less and more preferably 40 mm or less. If the diameter of the center is less than 25 mm, the thickness of the intermediate layer or the cover needs to be greater than a desired thickness, and hence the resilience may deteriorate. On the other hand, if the diameter of the center exceeds 41 mm, the thickness of the intermediate layer or the cover needs to be smaller than the desired thickness, and hence the intermediate layer or the cover may not function well.

When the center has a diameter in a range from 25 mm to 41 mm, a compression deformation amount of the center (an compression amount of the center in the compression direction thereof) when applying an initial load of 98 N to a final load of 1275 N is preferably 1.5 mm or more and more preferably 2.0 mm or more, and is preferably 5.0 mm or less and more preferably 4.0 mm or less. If the compression deformation amount is less than 1.5 mm, the shot feeling may become hard and deteriorate. If the compression deformation amount exceeds 5.0 mm, the resilience may deteriorate.

The surface hardness Hs1 in Shore D hardness of the center is preferably 40 or more, more preferably 48 or more, and even more preferably 54 or more, and is preferably 75 or less, more preferably 67 or less, and even more preferably 64 or less. If the surface hardness Hs1 in Shore D hardness of the center is less than 40, the golf ball becomes excessively soft and the resilience may deteriorate, thereby decreasing the flight distance. On the other hand, if the surface hardness Hs1 in Shore D hardness of the center is more than 75, the golf ball becomes excessively hard and the shot feeling may deteriorate.

The diameter of the core of the golf ball of the present invention is preferably 30 mm or more, more preferably 35 mm or more, and even more preferably 37 mm or more. By causing the diameter of the core to be 30 mm or more, the cover does not become excessively thick and desirable resilience of the golf ball is obtained. Further, the diameter of the core is preferably 41.5 mm or less, more preferably 41.25 mm or less, and even more preferably 41.0 mm or less. By causing the diameter of the core to be 41.5 mm or less, the sufficient thickness of the cover can be ensured and a protection effect of the cover is sufficiently obtained.

It is preferable that the core of the present invention has a larger surface hardness Hs than the center hardness Ho. The hardness difference (Hs−Ho) between the surface hardness Hs and the center hardness Ho of the core in the golf ball of the present invention is preferably 10 or larger, more preferably 15 or larger, even more preferably 20 or more in Shore D hardness. Making the surface hardness of the core larger than the center hardness increases the launch angle and decreases the amount of spin, thereby improving the flight distance of the golf ball. The hardness difference (Hs−Ho) between the surface hardness Hs and the center hardness Ho of the core is, without limitation, preferably 55 or less, more preferably 50 or less, even more preferably 40 or less in Shore D. If the hardness difference is too large, the durability of the golf ball tends to be lower.

The center hardness Ho of the core is preferably 20 or larger, more preferably 27 or larger, and even more preferably 32 or larger in Shore D hardness. If the center hardness Ho is 20 or larger in Shore D hardness, the core does not become too soft, resulting in the good resilience. The center hardness Ho of the core is preferably 60 or smaller, more preferably 53 or smaller, and even more preferably 48 or smaller in Shore D. If the center hardness Ho is 60 or less in Shore D hardness, the core does not become too hard, resulting in the good shot feeling. In the present invention, the center hardness Ho of the core is the hardness measured with the Shore D type spring hardness tester at the central point of a cut plane of a core which has been cut into two halves.

The surface hardness Hs of the core is preferably 40 or larger, more preferably 48 or larger, and even more preferably 54 or larger in Shore D hardness. If the surface hardness Hs is 40 or larger, the core does not become too soft, and the good resilience would be obtained. The surface hardness Hs of the core is preferably 75 or smaller, more preferably 67 or smaller, and even more preferably 64 or smaller in shore D hardness. If the surface hardness Hs is 75 or less in Shore D hardness, the core does not become too hard, and the good shot feeling would be provided.

The following will describe the cover of the golf ball of the present invention. Examples of the resin component of the cover composition for forming the cover include, in addition to a polyurethane resin and a known ionomer resin, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polystyrene elastomer having a trade name "Rabalon (registered trademark)" commercially available from Mitsubishi Chemical Corporation, and the like. These resin components may be used solely or in combination of two or more types thereof. Among them, a polyurethane resin is preferable.

The cover composition for forming the cover of the golf ball of the present invention contains a polyurethane resin as the resin component in an amount of preferably 50 mass % or more, more preferably 60 mass % or more, and even more preferably 70 mass % or more. In a more preferable embodiment, the resin component in the cover composition consists of the polyurethane resin.

The polyurethane resin is not particularly limited to one resin as long as it has a plurality of urethane bonds within the molecule. For example, the polyurethane resin can be obtained by reacting a polyisocyanate component with a high-molecular-weight polyol component to have urethane bonds formed within the molecule. Further, a chain extension reaction with a low-molecular-weight polyol, a low-molecular-weight polyamine, or the like is performed if necessary.

The slab hardness in Shore D hardness of the polyurethane resin is preferably 10 or more, more preferably 20 or more, and even more preferably 30 or more, and is preferably 65 or less, more preferably 60 or less, and even more preferably 55 or less. If the hardness of the polyurethane resin is excessively low, the spin rate upon a shot with a driver may increase. Further, if the hardness of the polyurethane resin is excessively high, the spin rate upon a shot with an approach wedge may become excessively low. Specific examples of the polyurethane resin include Elastollan (registered trademark) XNY 90A, XNY75A, and ET880 manufactured by BASF Japan Ltd., and the like.

In the present invention, in addition to the aforementioned resin component, the cover may contain a pigment component such as titanium oxide, a blue pigment, a red pigment, and the like, a specific gravity adjusting agent such as zinc oxide, calcium carbonate, barium sulfate, and the like, a dispersant, an antioxidant, an ultraviolet absorber, a light stabilizer, a fluorescent material or a fluorescent brightener, and the like as long as they do not impair the performance of the cover.

The amount of the white pigment (titanium oxide), with respect to 100 parts by mass of the resin component for forming the cover, is preferably 0.5 parts by mass or more and more preferably 1 parts by mass or more, and is preferably 10 parts by mass or less and more preferably 8 parts by mass or less. By causing the amount of the white pigment to be 0.5 parts by mass or more, it is possible to provide opacity to the cover. If the amount of the white pigment is more than 10 parts by mass, there is the possibility that the durability of the resultant cover will deteriorate.

The slab hardness in Shore D hardness of the cover composition is preferably 60 or less, more preferably 53 or less, and even more preferably 48 or less. By causing the slab hardness of the cover composition to be 60 or less, the spin stability upon an approach shot with a short iron and the like is enhanced. As a result, a golf ball with excellent controllability upon an approach shot is obtained. In order to ensure a sufficient spin rate upon an approach shot, the slab hardness in Shore D hardness of the cover composition is preferably 20 or more, more preferably 27 or more, and even more preferably 32 or more.

An embodiment for molding a cover is not particularly limited, and includes an embodiment which comprises injection molding the cover composition directly onto the core, or an embodiment which comprises molding the cover composition into a hollow-shell, covering the core with a plurality of the hollow-shells and subjecting the core with a plurality of the hollow shells to the compression-molding (preferably an embodiment which comprises molding the cover composition into a half hollow-shell, covering the core with the two half hollow-shells, and subjecting the core with the two half hollow-shells to the compression-molding). In the case of directly injection molding the cover composition onto the core, it is preferred to use upper and lower molds for forming a cover having a spherical cavity and pimples, wherein a part of the pimple also serves as a retractable hold pin. When forming the cover by injection molding, the hold pin is protruded to hold the core, and the cover composition which has been heated and melted is charged and then cooled to obtain a cover. For example, the cover composition heated and melted at the temperature of 150° C. to 230° C. is charged into a mold held under the pressure of 980 KPa to 1,500 KPa for 0.1 to 1 second. After cooling for 15 to 60 seconds, the mold is opened and the golf ball with the cover molded is taken out from the mold.

When molding the cover in a compression molding method, molding of the half shell can be performed by either compression molding method or injection molding method, and the compression molding method is preferred. The compression-molding of the cover composition into half shell can be carried out, for example, under a pressure of 1 MPa or more and 20 MPa or less at a temperature of −20° C. or more and 70° C. or less relative to the flow beginning temperature of the cover composition. By performing the molding under the above conditions, a half shell having a uniform thickness can be formed. Examples of a method for molding the cover using half shells include compression molding by covering the core with two half shells. The compression molding of half shells into the cover can be carried out, for example, under a pressure of 0.5 MPa or more and 25 MPa or less at a temperature of −20° C. or more and 70° C. or less relative to the flow beginning temperature of the cover composition. By performing the molding under the above conditions, a cover for a golf ball having a uniform thickness can be formed.

When molding a cover, the concave portions called "dimple" are usually formed on the surface. After the cover is molded, the mold is opened and the golf ball body is taken out from the mold, and as necessary, the golf ball body is preferably subjected to surface treatment such as deburring, cleaning, and sandblast. If desired, a paint film or a mark may be formed. The paint film preferably has a thickness of, but not limited to, 5 μm or larger, and more preferably 7 μm or larger, and preferably has a thickness of 25 μm or smaller, and more preferably 18 μm or smaller. This is because if the thickness is smaller than 5 μm, the paint film is easy to wear off due to continued use of the golf ball, and if the thickness is larger than 25 μm, the effect of the dimples is reduced, resulting in deteriorating flying performance of the golf ball.

In the present invention, the thickness of the cover of the golf ball is preferably 3 mm or less, more preferably 2.5 mm or less, and even more preferably 2 mm or less. This is because by causing the thickness of the cover to be 3 mm or less, desirable resilience and shot feeling are obtained. The thickness of the cover is preferably 0.1 mm or more, more preferably 0.2 mm or more, and even more preferably 0.3 mm or more. This is because if the thickness of the cover is less than 0.1 mm, there is the possibility that it becomes difficult to form the cover. In addition, the durability and the abrasion resistance of the cover may deteriorate.

The golf ball of the present invention can have various structures, as long as it includes: a core consisting of a center and one or more intermediate layers covering the center; and a cover covering the core. Specific examples of the golf ball of the present invention include a three-piece golf ball comprising a core consisting of a center and an intermediate layer covering the center, and a cover covering the core; a four-piece golf ball comprising a core consisting of a center and a two-layer intermediate layer covering the center, and a cover covering the core; and a multi-piece golf ball comprising a core consisting of a center and multi-piece of intermediate layers or multi-layer of intermediate layers covering the center, and a cover covering the core. Among them, the present invention is suitably applicable to a three-piece golf ball comprising a core consisting of a center and a single-layer intermediate layer covering the center, and a cover covering the core.

As the golf ball of the present invention, a three-piece golf ball, which includes: a core consisting of a center and a single-layer intermediate layer covering the center; and a cover covering the core, and in which the intermediate layer is formed from the highly elastic intermediate layer composition, is most preferable.

When the golf ball of the present invention has a diameter in a range from 40 mm to 45 mm, a compression deformation amount of the golf ball (an amount of compression of the golf ball in the compression direction thereof) when applying an initial load of 98 N to a final load of 1275 N to the golf ball is preferably 2.0 mm or more, more preferably 2.1 mm or more, and even more preferably 2.2 mm or more, and is preferably 3.0 mm or less, more preferably 2.9 mm or less, and even more preferably 2.8 mm or less. By causing the compression deformation amount to be 2.0 mm or more, desirable shot feeling is obtained. By causing the compression deformation amount to be 3.0 mm or less, desirable resilience is obtained.

EXAMPLES

Hereinafter, the present invention will be described in detail by way of example. The present invention is not limited to examples described below. Various changes and modifications can be made without departing from the spirit and scope of the present invention.

(1) Flexural Modulus (MPa)

A test sheet with a length of 80.0±2 mm, a width of 10.0±0.2 mm, and a thickness of 4.0±0.2 mm was produced by injection molding using a highly elastic intermediate layer composition, and stored at 23° C. for two weeks. The flexural modulus of this sheet was measured according to ISO178. The measurement was conducted at a temperature of 23° C. and a humidity of 50% RH.

(2) Tensile Modulus (MPa)

A sheet with a thickness of about 2 mm was produced by injection molding using a highly elastic intermediate layer composition, and stored at 23° C. for two weeks. A dumbbell-shaped test piece was produced from this sheet, and the tensile modulus of the test piece was measured according to ISO 527-1.

(3) Slab Hardness (Shore D Hardness)

Sheets with a thickness of about 2 mm were produced by injection molding using a cover composition or a highly elastic intermediate layer composition, and stored at 23° C. for two weeks. Three or more of these sheets were stacked on one another so as not to be affected by the measuring base on which the sheets were placed, and the stack was measured with a type P1 auto loading durometer manufactured by Kobunshi Keiki Co., Ltd., which comprises a Shore D type spring hardness tester which complies to ASTM-D2240 standard.

(4) Hardnesses of Center and Core (Shore D Hardness)

A type P1 auto loading durometer manufactured by Kobunshi Keiki Co., Ltd., which comprises a Shore D type spring hardness tester which complies to ASTM-D2240 standard was used to measure the surface hardness Hs1 of the center and the surface hardness Hs of the core. Shore D hardnesses measured at the surfaces of the center and the core were used as the surface hardness Hs1 of the center and the surface hardness Hs of the core. The core was cut into two hemispheres to obtain a cut plane, and a Shore D hardness measured at the center of the cut plane was used as the central hardness Ho of the center or the core.

(5) Compression Deformation Amount (mm)

A compression deformation amount of the golf ball or the core (an amount of compression of the golf ball or the core in the compression direction thereof), when applying an initial load of 98 N to a final load of 1275 N, was measured.

(6) Durability

A metal-headed W#1 driver (XXIO S, loft: 11°, manufactured by SRI Sports Limited) was installed on a swing robot M/C manufactured by Golf Laboratories, Inc. Each golf ball was hit at a head speed of 45 m/sec. This procedure was repeated, and the number of hits required to break the golf ball was counted. It is noted that there was a case where the golf ball looks unbroken but a crack occurs in the intermediate layer. In such a case, whether or not the golf ball was broken was determined based on deformation of the golf ball and difference in sound at hitting of the golf ball.

The number of hits for golf ball No. 8 was defined as an index of 100, and the durability of each golf ball was represented by converting the number of hits for each golf ball into this index. A greater index value indicates that the durability of the golf ball is excellent.

(7) Shot with Driver

A metal-headed W#1 driver (XXIO S, loft: 11°, manufactured by SRI Sports Limited) was installed on a swing robot M/C manufactured by Golf Laboratories, Inc. A golf ball was hit at a head speed of 50 m/sec, and the speed of the golf ball immediately after the hit, the launch angle, the spin rate, and the flight distance (the distance from the launch point to the stop point) were measured. This measurement was conducted twelve times for each golf ball, and the average value was used as the measurement value for the golf ball. Regarding the speed and the spin rate of the golf ball immediately after the hit, a sequence of photographs of the hit golf ball was taken to measure the spin rate and the initial speed. Regarding the speed, the launch angle, the spin rate, and the flight distance of each golf ball, the value for golf ball No. 8 was defined as an index of 100, and the evaluation result of each golf ball was represented by converting the value for each golf ball into this index.

(8) Shot with Short Iron

A sand wedge was installed on a swing robot M/C manufactured by Golf Laboratories, Inc. A golf ball was hit at a head speed of 21 m/sec. The measurement was conducted twelve times for each golf ball, and the average value was used as the spin rate. Regarding the spin rate of each golf ball, the value for golf ball No. 8 was defined as an index of 100, and the evaluation result of each golf ball was represented by converting the value for each golf ball into this index. The range of the spin rate is the difference between the maximum value and the minimum value among the spin rates of twelve times. A narrower range of the spin rate indicates that the spin stability is high.

Evaluation Criteria for Range of Spin Rate

A: The range is less than 100 rpm.

B: The range is 100 rpm or more and 200 rpm or less.

C: The range is 200 rpm or more.

[Production of Golf Ball]

(1) Production of Center

A center was obtained by kneading a rubber composition having the formulation shown in Table 1, and heat-pressing the kneaded object in upper and lower molds, each having a hemispherical cavity, at 170° C. for 30 minutes.

TABLE 1

| Center | | |
|---|---|---|
| Formulation | Polybutadiene | 100 |
| | Zinc acrylate | 31.5 |
| | Zinc oxide | 5 |
| | Barium sulfate | Appropriate amount*) |
| | Diphenyl disulfide | 0.3 |
| | Dicumyl peroxide | 0.9 |
| Properties | Diameter (mm) | 39.8 |
| | Surface hardness Hs1 (Shore D hardness) | 62 |
| | Compression deformation amount (mm) | 2.99 |

Formulation: parts by mass

*)Depending on the cover composition, adjustment was made such that the golf ball had a mass of 45.4 g.

Polybutadiene rubber: "BR-730 (high-cis polybutadiene)" manufactured by JSR Corporation.

Zinc acrylate: "ZNDA-90S" manufactured by Nihon Jyoryu Kogyo Co., Ltd.

Zinc oxide: "Ginrei R" manufactured by Toho Zinc Co., Ltd.

Barium sulfate: "Barium Sulfate BD" manufactured by Sakai Chemical Industry Co., Ltd.

Diphenyl disulfide: manufactured by Sumitomo Seika Chemicals Co., Ltd.

Dicumyl peroxide: "Percumyl (registered trademark) D" manufactured by NOF Corporation.

It is noted that an appropriate amount of barium sulfate was added such that the obtained golf ball had a mass of 45.4 g.

(2) Preparation of Cover Composition and Highly Elastic Intermediate Layer Composition A cover composition in the pellet form and a highly elastic intermediate layer composition in the pellet form were prepared by mixing materials shown in Tables 2 and 3 with a twin-screw kneading extruder. The extruding conditions were a screw diameter of 45 mm, a screw rotational speed of 200 rpm, and screw L/D=35, and the mixtures were heated to 160 to 230° C. at the die position of the extruder.

TABLE 2

| Cover composition | | |
|---|---|---|
| Formulation | Elastollan XNY85A | 100 |
| | Titanium oxide | 4 |
| Properties | Slab hardness (Shore D hardness) | 32 |

Formulation: parts by mass

Elastollan XNY85A: a thermoplastic polyurethane elastomer manufactured by BASF Japan Ltd.

(3) Production of Golf Ball Body

A spherical core was produced by injection-molding the highly elastic intermediate layer composition onto the center thus obtained to form an intermediate layer covering the center. Then, a golf ball was produced by injection-molding the cover composition onto the spherical core to form a cover. Upper and lower molds for molding each have a spherical cavity with pimples, a part of which serves as a hold pin which is extendable and retractable. The hold pins were protruded to hold the core, the resin heated to 210° C. was charged into the mold under a pressure of 80 ton within 0.3 seconds, and cooled for 30 seconds. Then, the mold was opened, and the golf ball body was taken out therefrom. The surface of the obtained golf ball body was treated with sandblast, marked, and painted with a clear paint. The paint was dried in an oven at 40° C., and a golf ball with a diameter of 42.8 mm and a mass of 45.4 g was obtained.

The evaluation results of durability, compression deformation amount, and flight distance for the obtained golf ball are shown in Table 3.

TABLE 3-1

| Golf ball No. | | | | | 1 | 2 | 3 | 4 | 5 |
|---|---|---|---|---|---|---|---|---|---|
| Core | Center Diameter (mm) | | | | 39.8 | 39.8 | 39.8 | 39.8 | 39.8 |
| | Intermediate layer | Formulation | (B) | Surlyn 8945 | 40 | 30 | 40 | — | 40 |
| | | | | Himilan AM7329 | 40 | 30 | 40 | — | 40 |
| | | | | Surlyn 8140 | — | — | — | 40 | — |
| | | | | Surlyn 9120 | — | — | — | 40 | — |
| | | | | Primalloy B1980N | — | — | — | — | — |
| | | | (A) | LEMMALOY BX505 | — | 40 | 20 | 20 | — |
| | | | | LEMMALOY C82HL | — | — | — | — | 20 |
| | | | | NOVADURAN 5505S | 20 | — | — | — | — |
| | | | (C) | LOTADER AX8840 | 5 | 5 | 5 | — | 5 |
| | | | | ARUFON UG-4030 | — | — | — | 2 | — |
| | | | | Bond Fast E | — | — | — | 3 | — |
| | | | | Titanium oxide | 4 | 4 | 4 | 4 | 4 |
| | Slab Hardness (Shore D) | | | | 65 | 70 | 66 | 67 | 66 |
| | Slab Felxural modulus (MPa) | | | | 375 | 488 | 300 | 395 | 434 |
| | Slab Tensile modulus (MPa) | | | | 430 | 498 | 440 | 485 | 480 |
| | Thickness (mm) | | | | 1.0 | 1.0 | 1.0 | 1.0 | 1.0 |
| | Central hardness Ho (Shoe D Hardness) | | | | 44 | 44 | 44 | 44 | 44 |
| | Surface hardness Hs (Shore D hardness) | | | | 68 | 72 | 68 | 71 | 69 |
| | Compression deformation amount (mm) | | | | 2.45 | 2.35 | 2.43 | 2.39 | 2.42 |
| | Cover Cover Thickness (mm) | | | | 0.5 | 0.5 | 0.5 | 0.5 | 0.5 |
| Body evaluation | Compression deformation amount (mm) | | | | 2.42 | 2.31 | 2.40 | 2.33 | 2.38 |
| | Durability (index) | | | | 117 | 108 | 135 | 121 | 103 |
| | Shot with driver | | | Ball speed | 100 | 100 | 100 | 100 | 100 |
| | | | | Launch angle | 104 | 104 | 104 | 103 | 105 |
| | | | | Spin rate | 98 | 95 | 98 | 96 | 96 |
| | | | | Flight distance | 102 | 102 | 104 | 102 | 103 |

TABLE 3-1-continued

| Golf ball No. | | | 1 | 2 | 3 | 4 | 5 |
|---|---|---|---|---|---|---|---|
| Shot with short iron | Spin rate | | 97 | 95 | 97 | 97 | 96 |
| | Spin stability | | A | A | A | A | A |

TABLE 3-2

| Golf ball No. | | | | | 6 | 7 | 8 | 9 | 10 |
|---|---|---|---|---|---|---|---|---|---|
| Core | Center Diameter (mm) | | | | 39.8 | 39.8 | 39.8 | 39.8 | 39.8 |
| | Intermediate layer | Formulation | (B) | Surlyn 8945 | — | — | 50 | — | — |
| | | | | Himilan AM7329 | — | — | 50 | — | — |
| | | | | Surlyn 8140 | 40 | 40 | — | — | — |
| | | | | Surlyn 9120 | 40 | 40 | — | — | — |
| | | | | Primalloy B1980N | — | — | — | 100 | — |
| | | | (A) | LEMMALOY BX505 | — | 20 | — | — | — |
| | | | | LEMMALOY C82HL | 20 | — | — | — | — |
| | | | | NOVADURAN 5505S | — | — | — | — | 100 |
| | | | (C) | LOTADER AX8840 | 5 | — | — | — | — |
| | | | | ARUFON UG-4030 | — | — | — | — | — |
| | | | | Bond Fast E | — | — | — | — | — |
| | | | | Titanium oxide | 4 | 4 | 4 | 4 | 4 |
| | Slab Hardness (Shore D) | | | | 68 | 68 | 65 | 78 | 77 |
| | Slab Flexural modulus (MPa) | | | | 450 | 420 | 282 | 845 | 750 |
| | Slab Tensile modulus (MPa) | | | | 697 | 470 | 375 | 890 | 750 |
| | Thickness (mm) | | | | 1.0 | 1.0 | 1.0 | 1.0 | 1.0 |
| | Central hardness Ho (Shoe D Hardness) | | | | 44 | 44 | 44 | 44 | 44 |
| | Surface hardness Hs (Shore D hardness) | | | | 70 | 72 | 68 | 79 | 78 |
| | Compression deformation amount (mm) | | | | 2.36 | 2.36 | 2.42 | 2.12 | 2.14 |
| | Cover Thickness (mmm) | | | | 0.5 | 0.5 | 0.5 | 0.5 | 0.5 |
| Body evaluation | Compression deformation amount (mm) | | | | 2.34 | 2.35 | 2.41 | 2.29 | 2.29 |
| | Durability (index) | | | | 127 | 101 | 100 | Unmeasurable * | |
| | Shot with driver | Ball speed | | | 101 | 100 | 100 | | |
| | | Launch angle | | | 106 | 104 | 100 | | |
| | | Spin rate | | | 95 | 94 | 100 | | |
| | | Flight distance | | | 102 | 106 | 100 | | |
| | Shot with short iron | Spin rate | | | 96 | 96 | 100 | | |
| | | Spin stability | | | A | A | C | | |

*They were unmeasurable because the golf balls were broken by one hit.

TABLE 3-3

| Golf ball No. | | | | | 11 | 12 | 13 | 14 |
|---|---|---|---|---|---|---|---|---|
| Core | Center Diameter (mm) | | | | 39.8 | 39.8 | 39.8 | 39.8 |
| | Intermediate layer | Formulation | (B) | Surlyn 8945 | — | — | 5 | 45 |
| | | | | Himilan AM7329 | — | — | 5 | 45 |
| | | | | Surlyn 8140 | — | — | — | — |
| | | | | Surlyn 9120 | — | — | — | — |
| | | | | Primalloy N1980N | — | — | — | — |
| | | | (A) | LEMMALOY BX505 | — | 100 | 90 | 10 |
| | | | | LEMMALOY C82HL | 100 | — | — | — |
| | | | | NOVADURAN 5505S | — | — | — | — |
| | | | (C) | LOTADER AX8840 | — | — | 5 | 5 |
| | | | | ARUFON UG-4030 | — | — | — | — |
| | | | | Bond Fast E | — | — | — | — |
| | | | | Titanium oxide | 4 | 4 | 4 | 4 |
| | Slab Hardness (Shore D) | | | | 80 | 80 | 79 | 65 |
| | Slab Flexural modulus (MPa) | | | | 2500 | 1500 | 1200 | 295 |
| | Slab Tensile modulus (MPa) | | | | 2300 | 1500 | 1200 | 350 |
| | Thickness (mm) | | | | 1.0 | 1.0 | 1.0 | 1.0 |
| | Central hardness Ho (Shoe D Hardness) | | | | 44 | 44 | 44 | 44 |
| | Surface hardness Hs (Shore D hardness) | | | | 82 | 82 | 81 | 66 |
| | Compression deformation amount (mm) | | | | 1.99 | 1.98 | 1.97 | 2.38 |
| | Cover Thickness (mm) | | | | 0.5 | 0.5 | 0.5 | 0.5 |

TABLE 3-3-continued

| Golf ball No. | | | 11 | 12 | 13 | 14 |
|---|---|---|---|---|---|---|
| Body evaluation | Compression deformation amount (mm) | | 2.27 | 2.27 | 2.27 | 2.49 |
| | Durability (index) | | Unmeasurable* | | | 50 |
| | Shot with driver | Ball speed | | | | 100 |
| | | Launch angle | | | | 100 |
| | | Spin rate | | | | 100 |
| | | Flight distance | | | | 101 |
| | Shot with short iron | Spin rate | | | | 103 |
| | | Spin stability | | | | C |

*They were unmeasurable because the golf balls were broken by one hit.

Notes on table 3-1 to 3-3

Formulation: parts by mass

Surlyn 8945: a sodium ion neutralized ethylene-methacrylic acid copolymer ionomer resin (flexural modulus: 254 MPa) manufactured by E.I. du Pont de Nemours and Company.

Himilan AM7329: a zinc ion neutralized ethylene-methacrylic acid copolymer ionomer resin (flexural modulus: 236 MPa) manufactured by Du Pont-Mitsui Polychemicals Co., Ltd.

Surlyn 8140: a sodium ion neutralized ethylene-methacrylic acid copolymer ionomer resin (flexural modulus: 330 MPa) manufactured by E.I. du Pont de Nemours and Company.

Surlyn 9120: a zinc ion neutralized ethylene-methacrylic acid copolymer ionomer resin (flexural modulus: 257 MPa) manufactured by E.I. du Pont de Nemours and Company.

Primalloy B1980N: a thermoplastic polyester elastomer manufactured by Mitsubishi Chemical Corporation.

LEMMALOY BX505 a polymer alloy (flexural modulus: 2200 MPa) of a polyphenylene ether resin and nylon 6, manufactured by Mitsubishi Engineering-Plastics Company.

LEMMALOY C82HL: a polymer alloy (flexural modulus: 2400 MPa) of a polyphenylene ether resin and nylon 66, manufactured by Mitsubishi Engineering-Plastics Company.

NOVADURAN 5505S: a polybutylene terephthalate resin (flexural modulus: 740 MPa) manufactured by Mitsubishi Engineering-Plastics Company.

LOTADER AX8840: an ethylene-acrylic acid ester-glycidyl methacrylate copolymer (amount of monomer containing a polar functional group: 8 mass %) manufactured by Tokyo Zairyo Co., Ltd.

AFURON UG-4030: a methyl methacrylate-glycidyl methacrylate copolymer (amount of monomer containing a polar functional group: 0.02 mass %, epoxy number: 1.8 meq/g) manufactured by Toagosei Co., Ltd.

Bond Fast E: an ethylene-glycidyl methacrylate copolymer (amount of monomer containing a polar functional group: 12 mass %) manufactured by Sumitomo Chemical Co., Ltd.

Golf balls No. 1 to 7 each include an intermediate layer formed from a highly elastic intermediate layer composition that contains, as a resin component, a highly elastic resin (A) and an ionomer resin (B) in a ratio (A)/(B) that equals (20 mass % to 80 mass %)/(80 mass % to 20 mass %). It is obvious that these golf balls No. 1 to 7 have improved durability, flight distance, and spin performance as compared to golf ball No. 8 that includes an intermediate layer formed from an intermediate layer composition consisting of an ionomer resin as a resin component. It is obvious that among them, golf balls No. 1 to 6, in which the highly elastic intermediate layer composition contains a resin (C) having a polar functional group in an amount of 2 parts by mass to 20 parts by mass with respect to 100 parts of the sum of the highly elastic resin (A) and the ionomer resin (B), have more improved durability.

Golf ball No. 9 to 12 each include an intermediate layer formed from an intermediate layer composition that consists of a thermoplastic polyester elastomer or a highly elastic resin (A) as a resin component. These golf balls do not have durability at a practical level. Golf ball No. 13 and 14 are each a golf ball in which the ratio ((A)/(B)) of a highly elastic resin (A) and an ionomer resin (B) in an intermediate layer composition is 90 parts by mass/10 parts by mass or 10 parts by mass/90 parts by mass, and it is obvious that both golf balls have inferior durability as compared to golf ball No. 8.

The present invention relates to a golf ball, and more specifically, is useful as a golf ball having excellent durability and flight distance. This application is based on Japanese Patent application No. 2008-117574 filed on Apr. 28, 2008, the contents of which are hereby incorporated by reference.

The invention claimed is:

1. A golf ball comprising:

a core consisting of a center and one or more intermediate layers covering the center; and a cover covering the core, wherein, at least one piece or one layer of said intermediate layers is formed from a intermediate layer composition that contains a resin (A) having a flexural modulus in a range from 700 MPa to 5000 MPa and an ionomer resin (B) having a flexural modulus in a range from 150 MPa to 1000 MPa in an amount ratio ((A)/(B)) of the highly elastic resin (A) to the ionomer resin (B) being (20 mass % to 80 mass %)/(80 mass % to 20 mass %) (the total is 100 mass %), and wherein the highly elastic resin (A) is a polymer alloy of polyphenylene ether and polyamide 6 or a polymer alloy of polyphenylene ether and polyamide 66.

2. The golf ball according to claim 1, wherein the intermediate layer composition further contains a resin (C) having a polar functional group in an amount of 0.1 part by mass to 30 parts by mass with respect to 100 parts by mass of the sum of the highly elastic resin (A) and the ionomer resin (B).

3. The golf ball according to claim 1, wherein regarding slab properties, the intermediate layer composition has a hardness in a range from 65 to 75 in Shore D hardness, a flexural modulus in a range from 300 MPa to 1000 MPa, and a tensile modulus in a range from 400 MPa to 1500 MPa.

4. The golf ball according to claim 1, wherein the intermediate layer composition contains the ionomer resin (B) in a content of 20 mass % or more and 80 mass % or less in a resin component constituting the intermediate layer composition.

5. The golf ball according to claim 1, wherein the resin (C) having a polar functional group is at least one selected from a group consisting of an ethylene-glycidyl methacrylate copolymer, an ethylene-acrylic acid-glycidyl methacrylate copolymer, and a methyl methacrylate-glycidyl methacrylate copolymer.

6. The golf ball according to claim 1, wherein the cover is formed from a cover composition that contains a polyurethane resin as a main component of a resin component.

7. The golf ball according to claim 1, wherein the resin (A) has a flexural modulus in a range from 800 MPa to 4000 MPa.

8. The golf ball according to claim 1, wherein the ionomer resin (B) has a flexural modulus in a range from 200 MPa to 600 MPa.

9. The golf ball according to claim 1, wherein the intermediate layer composition contains the resin (A) in a content of 20 mass % or more and 80 mass % or less in a resin component constituting the highly elastic intermediate layer composition.

* * * * *